United States Patent [19]

Deussen

[11] Patent Number: 4,773,548

[45] Date of Patent: Sep. 27, 1988

[54] TAMPER-EVIDENT CONTAINER WITH FRANGIBLE SEAL

[76] Inventor: Heino Deussen, Wallufer Strasse 25, D- 6228 Eltville, Fed. Rep. of Germany

[21] Appl. No.: 93,739

[22] Filed: Sep. 8, 1987

[30] Foreign Application Priority Data

Dec. 9, 1986 [DE] Fed. Rep. of Germany ... 8632961[U]

[51] Int. Cl.[4] ..... B65D 51/22

[52] U.S. Cl. ..... 215/2; 215/32; 222/541

[58] Field of Search ..... 215/226, 32, 2; 220/258, 266, 284; 222/541

[56] References Cited

U.S. PATENT DOCUMENTS

| | | | |
|---|---|---|---|
| 3,858,739 | 1/1975 | Turner et al. | 215/32 |
| 4,134,511 | 1/1979 | Deussen | 215/32 |
| 4,688,703 | 8/1987 | Bayer | 222/541 |

FOREIGN PATENT DOCUMENTS

| | | | |
|---|---|---|---|
| 2006712 | 5/1979 | United Kingdom | 215/32 |

*Primary Examiner*—Donald F. Norton

*Attorney, Agent, or Firm*—H. Gibner Lehmann; K. Gibner Lehmann

[57] ABSTRACT

A non-refillable, tamper-evident container for dispensable products, including a hollow container body having an axis and a discharge portion centered on the axis, the discharge portion having an end wall and an axially extending projection thereon, as well as a frangible link connecting the projection to the end wall. Rupture of the link creates an outlet for the contents of the container body. A protective cap is removably carried by the container body and encloses the discharge portion, end wall and solid projection thereof. The cap has a transparent, smooth and even surface constituting an inspection window to permit the condition and position of the solid projection of the container body to be viewed from the exterior of the container body and cap carried thereby.

12 Claims, 2 Drawing Sheets

TAMPER-EVIDENT CONTAINER WITH FRANGIBLE SEAL

BACKGROUND OF THE INVENTION

1. Field of the Invention

This invention relates generally to containers with frangible seals and of the type intended to dispense substances such as medications, in either liquid, paste or powder form. More particularly the invention involves containers of the tamper-evident variety.

2. Description of the Related Art

U.S. Pat. No. 4,134,511 illustrates a container construction with a frangible seal, to hold and dispense in doses, a liquid, pasty or powdery product. The container has a neck, which is shown to be of generally nozzle-like configuration, and has an annular neck extension which is pressed into a depression located inside a protective cap which is to be placed over the neck. The arrangement is such that when the cap is twisted on the container neck, the extension is severed from the neck at a weakened, pre-determined break-off point, and the container is thus opened. The severed neck extension is retained in the interior of the cap; since the cap is not transparent due to the opacity of the material of which it is constituted, and due to the presence of molded ribs or knurling, the prospective user cannot generally determine in practice whether or not the container is in its original, sealed condition.

In U.S. Pat. No. 3,858,739 there is illustrated a container for dispensing doses of liquid or pasty product, such as medications( having a sealing element in the form of a sealing cap which can be broken off the container neck. While it is immediately recognized with such a container when the sealing element is broken, such element is exposed without protection to environmental influences such as possible contamination, accumulation of bacteria, etc. Such contamination can be transmitted directly to the container opening at the break-off point when the opening is not covered by the cap.

In published German Gebrauchsmuster No. 85 04 383 there is disclosed a dispenser having an annular collar or circular web which surrounds and is disposed beyond the bared outlet of the container neck. This arrangement undesirably acts to trap and collect dirt and other contaminants at the outlet, and constitutes an unsanitary construction.

SUMMARY OF THE INVENTION

The embodiment example of the present invention consists of a small plastic body which is molded with a neck and a neck extension that is connected to the neck by a frangible web. The frangible web is located at a predetermined desired break-off point, at which place the neck extension portion sealingly closes off an outlet opening of the body. A protective plastic cap which can be placed over the neck is provided, such cap having a transverse top wall which contains a depression. The dimensions of the depression are such that when the cap is removed and inverted, the walls of the depression can be fitted snugly over the extension. Placing of the cap in this position and twisting it causes breakage of the extension from the container body neck, at the frangible web.

In the present construction, the protective cap, in transit as well as when it is placed over the container neck, is completely protected at its inside against the entry of contamination and germs or bacteria, while at the same time there is facilitated the visual observance of the condition of the container, at first glance and with certainty, and a determination as to whether or not the container is still in its original, sealed and antiseptic condition. As noted above, the cap has a transverse wall with a depression, constituting a seating hole for the container neck extension, and fitting of the depression over the extension, followed by twisting of the cap causes the extension to be broken off. Prior to the breaking off of the extension and with the cap in its normal, upright position on the container neck, the location of the depression on the cap is such that it will not interfere with viewing of the extension through a transparent inspection window of the cap when the latter is installed on the container neck.

When the cap is in its upright position on the neck, the bottom wall of the depression is substantially aligned with, and axially spaced from the upper end of the extension. Thus it can be determined at first glance, whether or not the neck extension is in its correct position on the end of the container neck. In addition to having the capability of looking at the neck extension inside the cap from outside the cap and at any angle, in the present construction there is sufficient room to accommodate a partial break-off of the extension, which would be indicated by a tilting of the extension on the neck. On the other hand, where the extension has been completely broken off and is freely movable inside the cap, it would no longer be possible for it to assume a position resembling its unbroken condition so as to result in a false indication of the extension being intact. Where the extension is completely severed, this alerts one to such fact by virtue of the extension being missing from within the transparent part of the cap. Also, the provision of the transparent part of the cap permits the observer to detect any leakage of the contents which may have occurred into the area inside of the cap.

In the preferred embodiment of the invention, in the circumferential cap portion that surrounds the container neck and/or the circumferential cap portion that surrounds the depression, there may be formed gripping ribs. However, the circumferential portion of the ca surrounding the neck extension is free of ribs or other elements which would render this part non-transparent.

In use, the cap is removed and reversed in position, and used as a tool, by inserting the extension into the depression, and turning the cap. In this manner, the extension is safely and completely removed from the container neck, insuring a reliable opening of the container. Proper seating of the inverted cap on the container neck is provided by an annular stop surface on the container neck, which surrounds the extension and the location of the frangible web, and a cooperable annular surface on the cap face, surrounding the depression. These engaging surfaces constitute a bearing or slide, permitting the cap to be forcibly twisted in accomplishing the severing of the extension from the container neck.

That portion of the transverse wall of the container neck which lies outside of the frangible web is preferably thicker than other portions of the neck wall. This arrangement insures that when the cap is applied in its inverted position to the extension and twisted (i. e. used as a removal tool), there is minimized the possibility of inadvertent collapse of the neck. Instead, the neck remains sufficiently stiff such that proper rupture of the web occurs, as opposed to an undesirable deformation of the neck. The container can thus be used to apply the substance therein to sensitive areas, such as the application of eye drops to the eye, without danger from possible protrusions from tearing of plastic, burrs, or the like. The opening provided is thus located at the center of the neck, between the thickened annular wall, to reduce the likelihood of inadvertent contamination.

Further, the container neck is provided with an annular shoulder below the extension, which shoulder constitutes an abutment for the rim of the opening of the cap that is placed over the container neck. The shoulder, engaged by the rim, assures a proper positioning of the cap on the container neck. This is considered important from the standpoint of locating the viewing window of the cap in a position wherein the extension can be properly viewed through the cap, from any angle.

Further, there exists a small axial space between the bottom wall of the depression and the end of the extension. Such a construction assures that no inadvertent tilting of the cap will cause movement or other type of disturbance to the extension. This feature is especially advantageous when combined with the annular shoulder and rim noted in the previous paragraph.

The previously mentioned drawbacks and disadvantages of prior dispensing containers are thus obviated by the present invention, and one object of the invention is to provide a novel and improved tamper-evident antiseptic dispensing container incorporating a protective cap, which container is completely protected at its inner dispensing surfaces against exposure to contamination, while at the same time permitting an observer to verify, with certainty, whether or not the container has been tampered with or disturbed in any way, and whether or not it is still in its original, sealed and untainted condition.

Another object of the invention is to provide an improved tamper-evident sealed and sanitary container as above characterized, which is simple to manufacture and produce, thereby maintaining the overall costs as low as possible.

Yet another object of the invention is to provide an improved tamper-evident sealed container of the kind indicated, wherein the same component is used as both a closure and as an opener tool, for facilitating initial opening of the container and subsequent sanitary resealing thereof.

A further object of the invention is to provide an improved sealed container as above set forth, which can be economically filled following assembly, and thereafter sealed by a simple fusing or welding procedure.

Still another object of the invention is to provide an improved tamper-evident sealed container as outlined above, which is both rugged and reliable in use, thereby minimizing problems with inadvertent breakage of the components and resultant premature failure of the sealing function.

According to the invention the above objects are fully accomplished by the provision of a novel nonrefillable, tamperevident container for dispensable products, comprising in combination a hollow container body adapted to be sealed after filling, the body having an axis and a discharge portion centered on the axis, and the discharge portion including an end wall, an axially extending projection on the end wall, and sealing means comprising a frangible link integrally connecting the projection to the end wall whereby rupture of the link can create an outlet for the contents of the body. A protective cap is removably carried by the container body and encloses the discharge portion, end wall and solid projection thereof. The cap has a rim defining its opening, and has a transverse closure wall remote from the rim. The closure wall has a socket in its exterior, which is adapted to receive and mate with the projection of the container body when the cap is reversed thereon. The cap has a first circumferential wall portion extending toward its closure wall from the rim that defines its opening, such first circumferential wall portion surrounding the discharge portion of the container body, and has a second circumferential wall portion connected to the first circumferential wall portion and also to the transverse wall of the cap, the second circumferential wall portion surrounding said solid projection. The second circumferential wall portion is transparent, having smooth and even surfaces and constituting an inspection window to permit the condition and position of the solid projection of the container body to be viewed from the exterior of the container body and cap carried thereby.

Other features and advantages will hereinafter appear.

DESCRIPTION OF THE PREFERRED EMBODIMENTS

Figure 1:
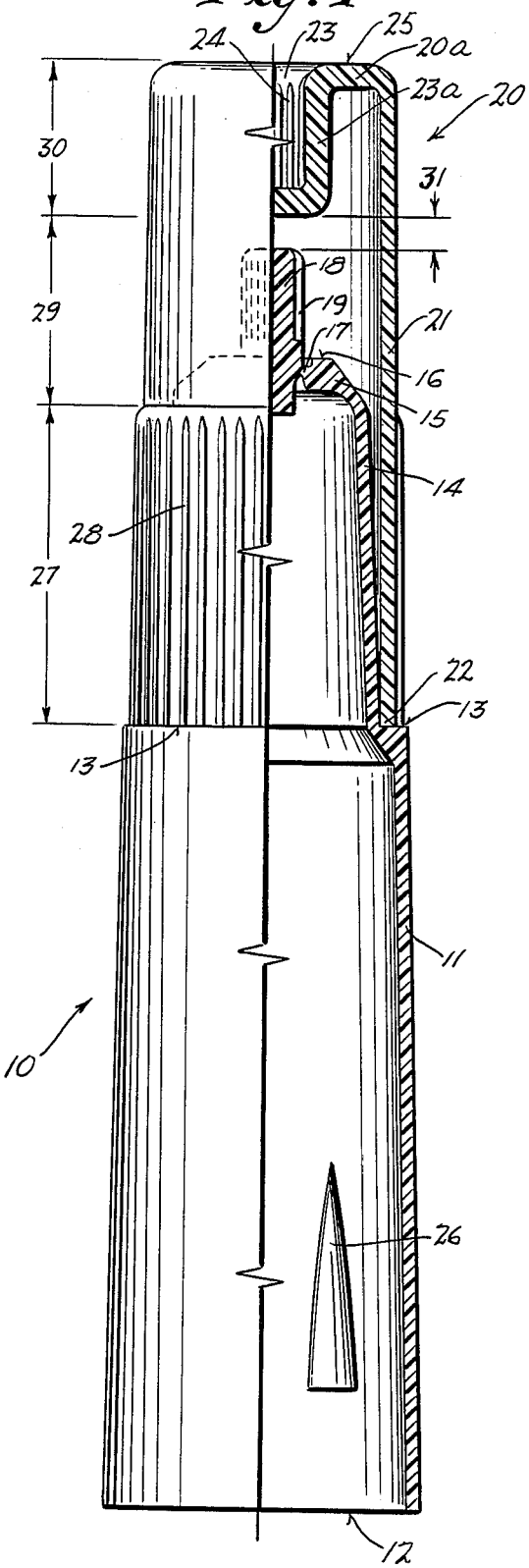
FIG. 1 is a view, partly in front elevation and partly in axial section, of a container constructed in accordance with the present invention, illustrating a protective cap installed in an upright position, as during storage or shipping.
Figure 2:
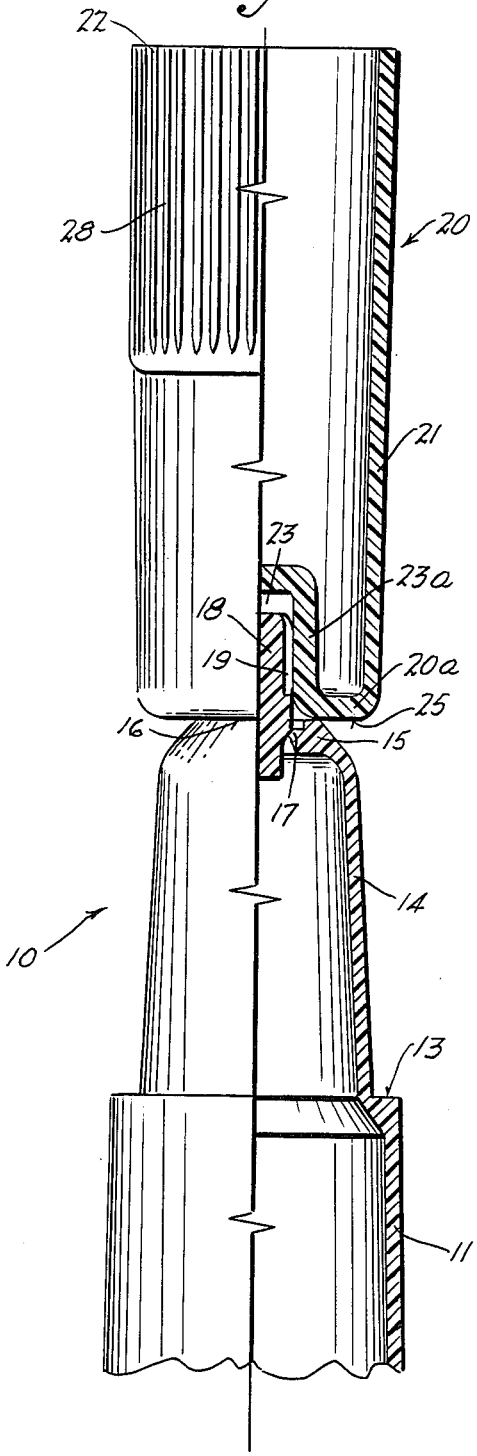
FIG. 2 is a fragmentary view, partly in front elevation and partly in axial section, of the container of FIG. 1 and wherein the protective cap has been removed, inverted and placed over the axial projection of the container body, in readiness for rupturing the web connecting the projection to the remainder of the body.
Figure 3:
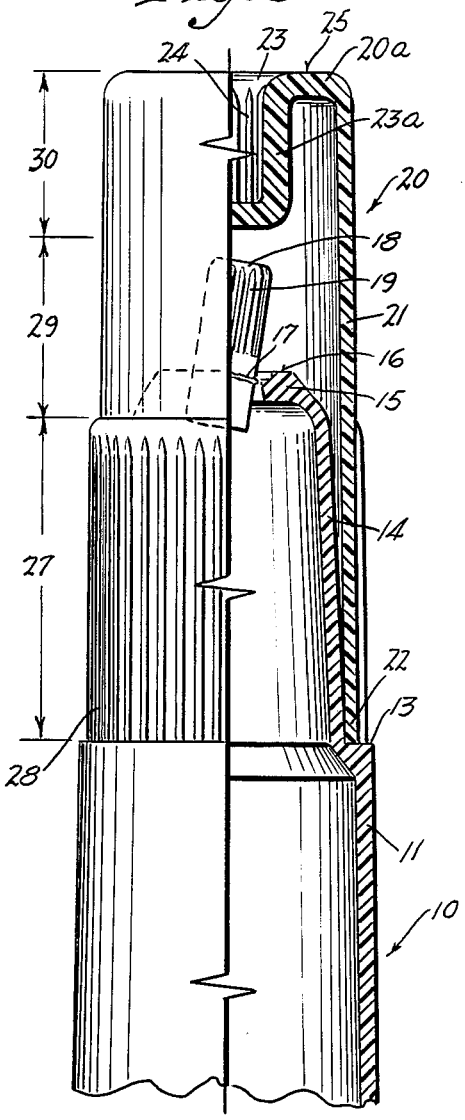
FIG. 3 is a fragmentary view of the container of FIGS. 1 and 2, illustrating the protective cap as having been re-positioned on the container body following the rupture of the web associated with the axial projection.

Referring to FIGS. 1–3 there is illustrated a container of essentially tubular configuration, generally designated by the numeral 10. The container 10 has an annular wall or body 11 with an opening 12 of generally circular configuration. An annular shoulder 13 is provided on the exterior of the wall 11, and the upper portion of the container has a discharge portion in the form of a nozzle-like neck 14 and a thickened end wall 15. The upper surface 16 of the end wall 15 constitutes a stop shoulder or positioning surface, as will be further explained below.

Lying within the surface 16 is an annular frangible web or link 17, constituting a sealing means, which supports an axiall extending solid projection or neck extension 18. The projection 18 has knurling 19 on its outer surface. The projection 18 can be forcibly twisted, causing the frangible web 17 to rupture and thereby creating an opening or outlet at the area previously occupied by the projection.

A protective cap 20 is provided for the body, having a side wall 21 of generally conical configuration, and having an open end which is positioned over the container neck 14. The rim 22 of the cap rests against the shoulder 13. There exists a friction fit between the inner surface of the cap 20 adjacent its rim 22 and the outer surface of the container neck 14.

The cap 20 has a transverse closure wall 20*a* at its end opposite the rim 22. Formed in the transverse wall 20*a* is a central depression or socket 23 having an annular wall 23*a*, provided with a plurality of axially extending ribs 24. The arrangement of the depression 23 enables the cap 20 to be removed and inverted, in the manner of FIG. 2, wherein the depression 23 can be fitted over the neck extension 18. The dimensions of the depression and extension are such that the ribs 24 and knurling 19 frictionally engage and interlock with one another, and the cap 20 is positioned such that its annular face 25 engages the stop surface 16 of the container neck. The mutually engaging surfaces, namely the face 25 and stop shoulder 16, thus form a slideway to assist in the breakaway of the web 17 when the cap 20 is forcibly turned.

Stated differently, when the cap is inverted as in FIG. 2, the walls of the depression 23 are keyed to the knurling 19 of the extension; twisting of the cap 20 will cause the web 17 to rupture, creating an opening or passage in the wall 15 of the container. The extension can be completely removed in this manner, or alternately, if less twisting force is applied to the cap, the extension will be retained by any remaining unbroken web 17. Prior to rupture of the web, as in FIG. 1, the extension 18 is disposed centrally of the axis of the container, and is free-standing on the wall 15 of the container neck. As an alternative, twisting of the extension can be done, at least partially, by using two fingers of the hand, or by bending the extension laterally. When partially torn out in this manner, the neck extension 18 no longer remains axially aligned with respect to the container.

In FIG. 1, three different areas or circumferential wall portions of the cap 20 are depicted. The circumferential area 27 overlies the container neck, and the exterior surfaces of the cap in this area is provided with a knurl 28. The part 29 is located adjacent the extension 18 when the cap 20 is attached. The part 30 is adjacent to the depression 23 in the cap.

In the present example, the part 29 which is adjacent to the extension 18 and the part 30 adjacent to the depression 23 are of transparent material, and are fre of knurls, ribs, or other elements which might interfere with viewing of the extension 18 from the exterior of the cap. However, the part 30 could optionally be provided with a knurl or ribbing, either instead of or in addition to the area 27. Omission of knurling or other elements from the area 29 permits an observer to view the condition of the extension from outside of the cap 20 when the cap is installed, as in FIG. 1, and this feature is thus considered to be an important aspect of the present invention, since it permits a rapid inspection of the position of the extension in the interior of the cap from all angles, that is, whether or not it is in an upright, perfectly aligned axial, centered position on the container neck, thereby providing a verification of the integrity of the seal provided by the extension, and indicates if tampering or other types of damage may have occurred to the container. If the neck extension 18 is in a tilted position, there exists the possibility of the web 17 having been partially torn open or ruptured.

If the extension 18 is torn out of the web 17 completely, it separates from the container neck, since no structure remains which would retain the extension.

It is noted that the bottom wall of the depression 23 which projects axially into the interior of the cap, is spaced a small axial distance 31 from the adjacent part of the extension 18, so that the latter, if torn and reinserted, would drop off the container at the slightest movement thereof.

Due to the transparent characteristic of the part 29 of the cap wall, it is thus clearly recognizable on first glance, whether or not the neck extension 18 is truly in its original position as shown in FIG. 1. The extension will remain in this position only if the web 17 is substantially completely intact and unbroken or otherwise undamaged.

FIG. 3 shows a portion of the container 10 after the extension 18 has been removed, and the protective cap 20 re-inserted over the neck. It is clearly seen through the part 29 of the cap wall, that the neck extension 18 is upset. Even if the neck extension 18 is broken off only partially, such that a hermetic seal is no longer maintained, this occurrence can be recognized by viewing the extension through the part 29 of the wall. The extension 18 will then no longer be axially aligned with respect to the end 15 of the container neck, and with the depression 23 formed in the end wall of the cap 20. Reference is made to FIG. 3, which shows in full and broken lines, the representation of the extension 18.

Figure 4:
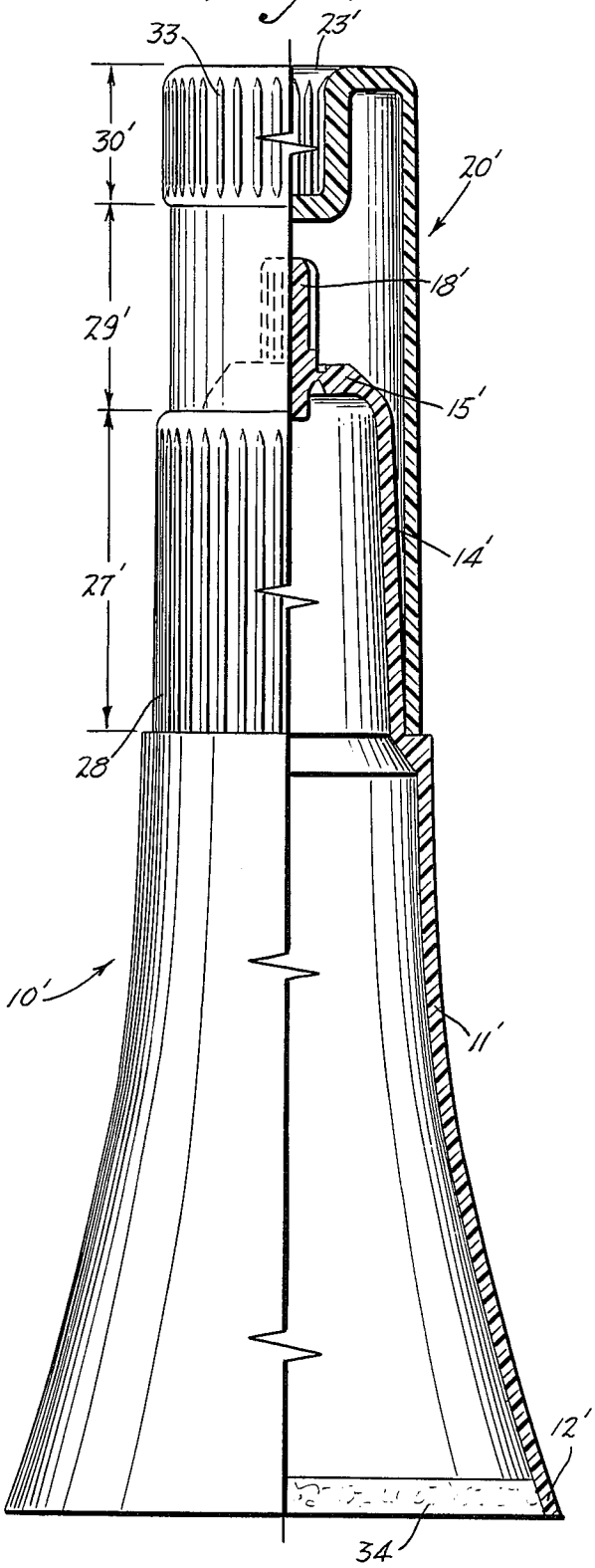
FIG. 4 is a view partly in front elevation and partly in axial section, of a modified container, constituting another embodiment of the invention.

FIG. 4 illustrates a somewhat modified construction, wherein the depression 23' of the cap 20' is concealed by a knurl or ribbing 33. The resulting inspection window remaining in the cap wall adjacent the designation 29' permits adequate viewing of the condition of the extension 18'. That is, the observer can view the extension 18' through this cylindrical window and verify that the extension is axially aligned with respect to the wall 15' of the container neck 14', and with respect to the depression 23'. The area or part 27' is shown as having ribbing.

With the cap 20 placed over the container neck 14 as in FIG. 1, the container 10 can be filled through its opening; thereafter, the walls adjacent the opening are squeezed in order to flatten them, and a "weld" formed therein, as indicated at 34 in FIG. 4. There is thus formed a tube-type dispenser, similar to a toothpaste tube. In order to prevent undesirable nesting and jamming of containers 10 prior to the filling thereof, by the invention there can be provided wedge-shaped anti-stacking projections 26 formed integrally with the container annular wall 11, as in FIG. 1.

FIG. 4 shows the container 10' in a filled condition, the rim of the opening 12' being squeezed flat, and welded or heat fused, along a strip 34.

Variations and modifications are possible without departin from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

What is claimed is:

1. A non-refillable, tamper-evident container (10) for dispensable products, comprising in combination:

(a) a hollow container body (11) adapted to be sealed after filling, said body having an axis and a discharge portion (14) centered on said axis, (b) said discharge portion (14) including an end wall (15), a solid, axially extending projection (18) standing free and alone and uncovered on said end wall (15), and sealing means (17) comprising a frangible link (17) integrally connecting said projection (18) to said end wall (15) whereby rupture of said link (17) can create an outlet for the contents of said body, (c) a protective cap (20) removably carried by the container body (11) and enclosing said discharge portion (14), end wall (15) and solid projection (18) thereof, said cap (20) having a rim (22) defining its opening, and having a transverse closure wall (20*a*) remote from said rim (22), said closure wall (20*a*) having a socket (23) in its exterior, which is adapted to receive and mate with the projection (18) of the container body (11) when the cap is reversed thereon, (d) said cap (20) having a first circumferential wall portion (27) extending toward its closure wall (20*a*) from the rim (22) defining its opening, said first circumferential wall portion (27) surrounding said discharge portion (14) of the container body (11), and said cap (20) having a second circumferential wall portion (29, 30) connected to the first circumferential wall portion (27) and to said transverse wall (20*a*) of the cap (20), said second circumferential wall portion (29, 30) surrounding said solid projection (18), and (e) said second circumferential wall portion (29, 30) being transparent, having smooth and even surfaces and constituting an inspection window to permit the condition and position of the solid projection (18) of the container body (11) to be viewed from the exterior of said container body (11) and cap (20) carried thereby.

2. The invention as defined in claim 1, wherein:

(a) the said second circumferential wall portion (29, 30) of said cap (20) surrounds the end wall (15) of the discharge portion (14) as well as the axially extending projection (18) on the end wall (15).

3. The invention as defined in claim 1, wherein:

(a) said first circumferential wall portion (27) has a plurality of gripping ribs (28), said ribs (28) terminating at the connection of said first (27) and second (29, 30) circumferential wall portions.

4. The invention as set forth in claim 1, wherein:

(a) the transverse closure wall (20*a*) of the cap (20) is spaced axially from the projection (18) on the end wall of the discharge portion (14) when the cap (20) is installed on the body (11).

5. A non-refillable, tamper-evident container for dispensable products, comprising in combination:

(a) a hollow container body (11) adapted to be sealed after filling, said body (11) having a discharge portion (14), (b) said discharge portion (14) including an end wall (15), a solid, axially extending projection (18) standing free and alone and uncovered on said end wall (15), and sealing means (17) comprising a frangible link (17) integrally connecting said projection (18) to said end wall (15) whereby rupture of said link (17) can create an outlet for the contents of said body (11), (c) a protective cap (20) removably carried by the container body (11), said cap (20) having a rim (22) defining its opening, and having a transverse closure wall (20*a*) remote from said rim (22), said closure wall (20*a*) having a socket (23) in its exterior, which is adapted to receive and mate with the projection (18) of the container body (11) when the cap (20) is reversed thereon, (d) said end wall (15) having a generally annular stop face (16) surrounding the axially extending projection (18), and said closure wall (20*a*) having an abutment surface (25) engageable with the stop face (16) of the end wall (15) when the cap (20) is reversed on the container body (11).

6. The invention as defined in claim 5, wherein:

(a) the end wall (15) of the discharge portion (14) is thickened at the location of the stop face (16), for increasing the rigidity thereof.

7. A non-refillable, tamper-evident container (10) for dispensable products, comprising in combination:

(a) a hollow container body (11) adapted to be sealed after filling, said body (11) having a discharge portion (14), (b) said discharge portion (14) including an end wall (15), a solid, axially extending projection (18) standing free and alone and uncovered on said end wall (15), and sealing means (17) comprising a frangible link (17) integrally connecting said projection (18) to said end wall (15) whereby rupture of said link (17) can create an outlet for the contents of said body (11), (c) a protective cap (20) removably carried by the container body (11) and having a rim (22) defining its opening, and having a transverse closure wall (20*a*) remote from said rim (22), said closure wall (20*a*) having a socket (23) in its exterior, which is adapted to receive and mate with the projection (18) of the container body (11) when the cap (20) is reversed thereon, (d) said cap (20) having a first circumferential wall portion (27) adjacent its rim (22), a second circumferential wall portion (29) connected to said first wall portion (27), and a third circumferential wall portion (30) connected between said second wall portion (29) and said transverse closure wall (20*a*), said second wall portion (29) comprising transparent material, so as to form a circumferential inspection window, said second wall portion (29) having substantially smooth wall surfaces.

8. The invention as defined in claim 7, wherein:

(a) the said second circumferential wall portion (29) surrounds the end wall (15) of the discharge portion (14) and the axially extending projection (18) thereon.

9. The invention as defined in claim 7, wherein:

(a) the transverse closure wall (20*a*) of the cap (20) is spaced axially from the projection (18) on the end wall (15) of the discharge portion (14) when the cap is (20) installed on the body (11).

10. A non-refillable, tamper-evident container (10) for dispensable products, comprising in combination:

(a) a hollow container body (11) adapted to be sealed after filling, said body (11) having a discharge portion (14), (b) said discharge portion (14) including an end wall (15), a solid, axially extending projection (18) on said end wall (15), and sealing means (17) comprising a frangible link (17) integrally connecting said projection (18) to said end wall (15) whereby rupture of said link (17) can create an outlet for the contents of said body (11), (c) a protective cap (20) removably carried by the container body (11) and having a rim (22) defining its opening, and having a transverse closure wall (20*a*) remote from said rim (22), said closure wall (20*a*) having a socket (23) in its exterior, which is adapted to receive and mate with the projection (18) of the container body (11) when the cap (20) is reversed thereon, (d) said cap (20) having a first circumferential wall portion (27) adjacent its rim (22), a second circumferential wall portion (29) connected to said first wall portion (27), and a third circumferential wall portion (30) connected between said second wall portion (29) and said transverse closure wall (20*a*), said second wall portion (29) being constituted of transparent material, so as to form a circumferential inspection window, said second wall portion (29) having substantially smooth wall surfaces, (e) the first (27′) and third (30′) circumferential wall portions comprising gripping ribs (28, 33) on the exterior surfaces thereof, said second circumferential wall portion (29′) being free of such ribs.

11. The invention as defined in claim 10, wherein:

(a) said container body (11) comprises an annular external shoulder (13) engageable by the rim (22) of the protective cap (20) when the latter is installed on the body (11).

12. A non-refillable, tamper-evident container (10) for dispensable products, comprising in combination:

(a) a hollow container body (11) adapted to be sealed after filling, said body (11) having an axis and a discharge portion (14) centered on said axis, (b) said discharge portion (14) including an end wall (15), a solid, axially extending projection (18) standing free and alone and uncovered on said end wall (15), and sealing means (17) comprising a frangible link (17) integrally connecting said projection (18) to said end wall (15) whereby rupture of said link (17) can create an outlet for the contents of said body (11), (c) a protective cap (20) removably carried by the container body (11) and enclosing said discharge portion (14), end wall (15) and solid projection (18) thereof, said cap (20) having a rim (22) defining its opening, and having a transverse closure wall (20*a*) remote from said rim (22), said closure wall (20*a*) having a socket (23) in its exterior, which is adapted to receive and mate with the projection (18) of the container body (11) when the cap (20) is reversed thereon, (d) said cap (20) having wall portions (27, 29, 30) extending toward its closure wall (20*a*) from the rim (22) defining its opening, said wall portions (27, 29, 30) surrounding said solid projection (18) and having a transparent inspection window (29) to permit the condition and position of the solid projection (18) to be viewed from the exterior of said container body (11) and cap (20) carried thereby.

* * * * *